United States Patent [19]

Dozier, Jr.

[11] Patent Number: 4,980,688

[45] Date of Patent: Dec. 25, 1990

[54] REGENERATOR

[75] Inventor: James J. Dozier, Jr., Rockville, Md.

[73] Assignee: The United States of America as represented by the Secretary of the Navy, Washington, D.C.

[21] Appl. No.: 843,598

[22] Filed: Sep. 30, 1959

[51] Int. Cl.[5] ..... H01Q 15/18

[52] U.S. Cl. ..... 342/9; 342/15

[58] Field of Search ..... 343/18; 102/19.2; 9/8.3, 8.3 E

[56] References Cited

U.S. PATENT DOCUMENTS 2,411,787 11/1946 Hammond, Jr. .

2,463,517 3/1949 Chromak .

2,888,675 5/1959 Pratt et al. .

*Primary Examiner*—Nelson Moskowitz

*Assistant Examiner*—Mark Hellner

*Attorney, Agent, or Firm*—Luther A. Marsh

[57] ABSTRACT

A radar countermeasure comprising an inflatable balloon, a corner reflector mounted inside said balloon, and means mounted on top of said balloon for destroying said balloon upon the incidence of a search radar beam, said means comprising a radar receiving antenna, a diode connected to said antenna, a standard length pulse generator connected to said diode responsive to radar signals having a period of over 0.2 microseconds, means connected to said generator for providing an output when a plurality of pulses are remitted from said pulse generator in a predetermined period of time, and an explosive charge connected to the output of said last named means for providing a warning signal upon the incidence of a search radar sweep.

18 Claims, 2 Drawing Sheets

FIG. 1.
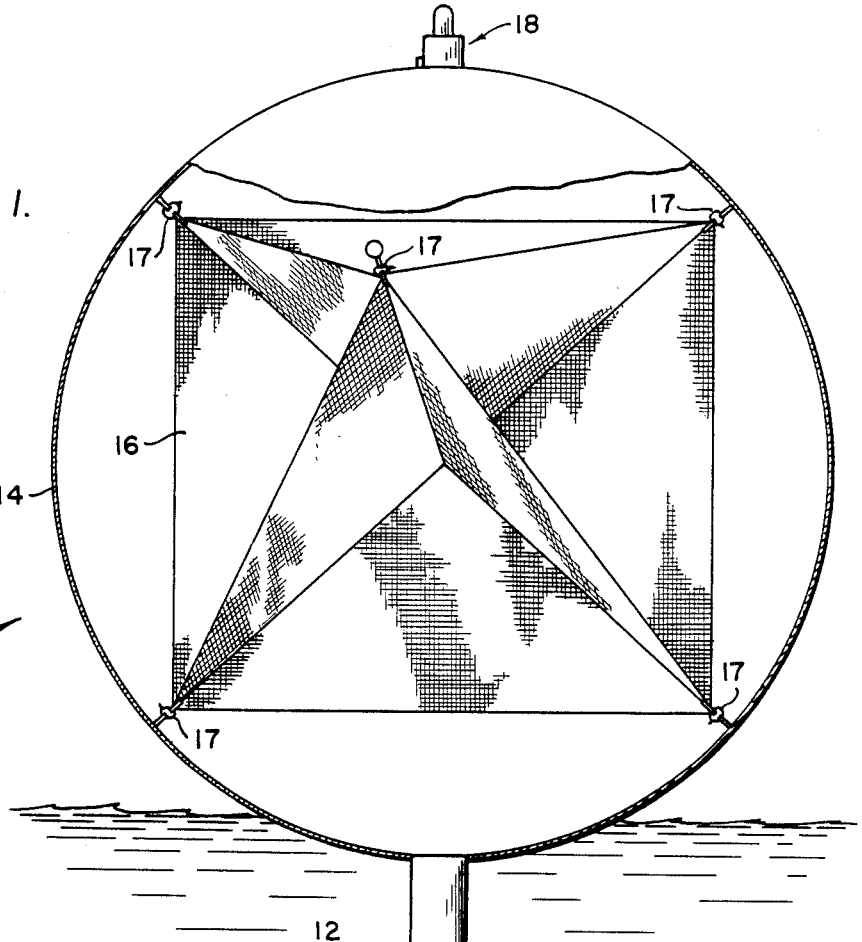
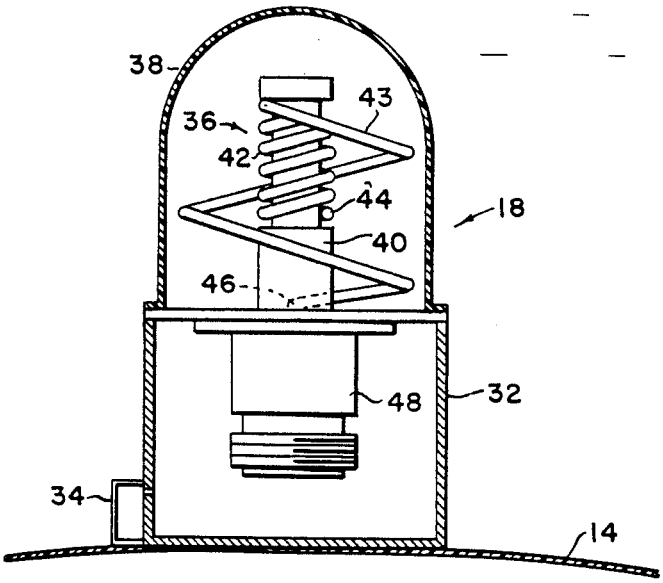
FIG. 2.
BY

REGENERATOR

The invention described herein may be manufactured and used by or for the Government of the United States of America for governmental purposes without the payment of any royalties thereon or therefor.

This invention relates to a regenerator for a radar countermeasure and more particularly to a system for simulating the snorkel tube of a submerged submarine to a search radar.

At the present time in anti-submarine warfare, aircraft mounted, search radar of 3–10 cm. wavelength is the most practical apparatus for covering large ocean areas. When an object is detected on the surface of the water which reflects an appreciable radar signal, the object must be investigated, its location radioed to a control center, and depth charges or bombs may be dropped if it appears that the object may be an enemy vessel.

If an object appears on the screen of a search plane, the radar observe can only interpret the signal as a snorkelling submarine or as a decoy. In either case the expenditure of depth charges is warranted on the 50—50 basis that the submerged object is a snorkelling submarine.

It is therefore a primary object of this invention to disclose a radar countermeasure which will float on the water and reflect a substantial signal to a search radar and then vanish beneath the ocean surface.

It is another object of this invention to disclose an antenna and regenerator circuit for detecting a radar signal so that the countermeasure may be destroyed by an explosive charge.

It is another object of this invention to disclose a novel noise discriminator and pulse counter for radar signals.

Other objects and many of the attendant advantages of this invention will be readily appreciated as the same become better understood by reference to the following detailed description when considered in connection with the accompanying drawings wherein:

FIG. 1 is an elevation view, partly in cross-section, of the radar countermeasure;

FIG. 2 is a cross-sectional view of the antenna, regenerator, and explosive charge mounted on top of the balloon;

Figure 3:
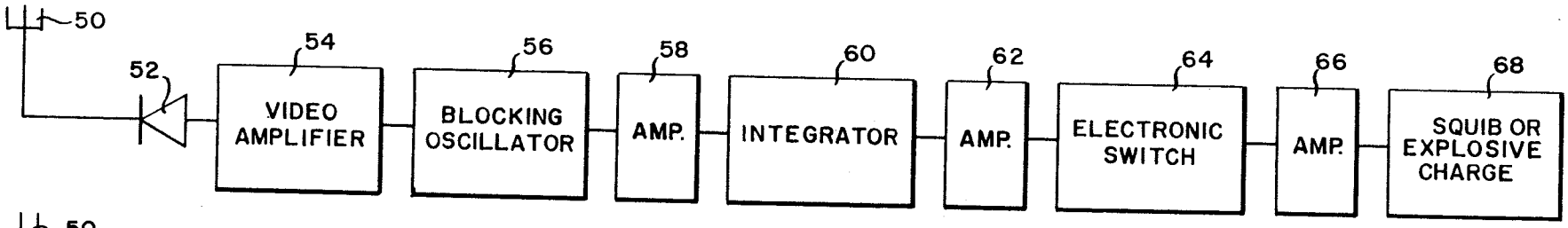
FIG. 3 is a block diagram of the regenerator circuit.

Referring now to the drawings, there is shown in FIG. 1 a radar countermeasure 10 floating in the ocean 12 comprising an inflatable balloon 14, a collapsible corner reflector 16 mounted inside the balloon 14, a detector unit 18 mounted on top of the balloon 14, and a chemical canister 20 joined by an inflating tube 22 to the bottom of the balloon 14.

The chemical canister 20 comprises a cylinder 24 having a central vent tube 26 attached to the bottom of the canister and extending upwardly toward the balloon and containing 3 lbs. of lithium hydride 28.

In operation the countermeasure 10 is tossed overboard or ejected from the signal tube of a submarine. Sea water enters tube 26 and reacts with the lithium hydride 28 to generate a copious amount of hydrogen gas to inflate balloon 14 and thereby extend reflector 16 to its proper size. The balloon 14 then floats on the surface of the water 12 and the heavy canister 24 is supported four feet below the balloon 14 and the surface of the water 12 by inflating tube 22.

When the balloon 14 and tube 22 become filled with hydrogen gas, the excess gas is exhausted through vent tube 26. Any gas leakage through the balloon 14 or decrease in gas pressure will allow sea water to enter vent tube 26 to generate more gas to re-inflate the balloon. Thus the balloon 14 will be automatically regulated to a pressure of 4 feet of water or about 2 pounds per square inch above atmospheric pressure.

The balloon 14 in a preferred embodiment is made of 0.010 inch thick polyvinyl chloride to a 48 inch diameter. The corner reflector 16 is made of silver covered nylon cloth for flexibility and maximum reflection. The corner reflector 16 has the desirable property of reflecting back incident radar waves in the direction of the source of the radar waves. The corner reflector can be constructed by joining three rectangular planes to each other along their diagonals with a right angle between any two planes. A plurality of triangular right angle pockets are thus formed to provide 180° reflection for all incident radar waves. The corner reflector 16 is attached at its corners by elastic straps 17 which are glued to the inside of balloon 14.

For a corner reflector 16 as shown having a length of three feet along a side, the radar cross-section for a 3 cm. radar is 35,000 square feet or about the area of a fleet tanker and the radar cross-section for a 10 cm. radar is 3120 square feet or about the size of a small freighter.

The radar cross-section of a target is a measure of the intensity of the signal which will be received from the target by a given radar under ideal conditions. It indicates nothing about the length or breadth of the target, or about the probability of detecting the target under other than ideal conditions. Due to interference effects, the intensity of any practical target will vary with the heights of the target and the radar antenna. In general, for two targets having the same radar cross-section but differeing in physical dimensions, there will be more variation in signal strength for the smaller target. Also, regardless of the intensity of the signal return, the smaller target will appear physically smaller to the radar operator, at least so long as both targets are near enough to give a reasonably strong return.

Thus, a 3-ft. corner reflector cannot be made to simulate an 800-ft. ship, even though both may have the same radar cross-section. This fact does not necessarily detract from the tactical usefulness of the corner reflector so far as Naval warfare is concerned, since one of the most potent enemies of surface ships—the snorkel submarine—presents a radar target of only small physical size when running with the snorkel tube surfaced.

The corner reflector will have a maximum free space range of 34 and 43 nautical miles respectively for 3 and 10 cm. radar mounted on shipboard with about 100 nautical mile range for an airborne radar.

Since in actual use the balloon 14 will be destroyed by the detector unit 18 as explained below when the reflected signal first appears on the radar screen at the maximum range of the radar, there will be little information available to the radar operator as to the actual identity of the reflected signal since the difference between the radar cross-section and the actual cross-section area of a target only becomes apparent at relatively short radar distances and after a relatively long viewing time and plurality of radar sweeps.

When a radar signal in the L to X bands impinges on the countermeasure 10, it is reflected by the corner reflector 16 to provide a signal to the radar operator and is detected by the detector unit 18 to ignite an explosive charge to destroy the balloon 14 and allow the heavy canister 24 to sink the entire countermeasure 10 to simulate the retraction of the snorkel of a submarine.

As shown in more detail in FIG. 2, the detector unit 18 comprises an aluminum container 32 glued to the top of balloon 14, a squib holder 34 attached to container 32 for destroying the balloon 14, a helical antenna 36 for receiving radar signals, and a Fiberglass cover 38 comprising glass fiber cloth formed to the proper shape and impregnated with a polyester resin.

Helical antenna 36 is a ground plane type having a central plastic rod 40 made of ½ inch diameter Lucite or methyl methacrylate mounted vertically on the top of aluminum container 32. The antenna coil 42 comprises 5¼ turns of 0.071 inch diameter wire around rod 40 which is extended to form antenna wire 43 comprising 1¼ turns self-supported on a 1½ inch diameter. The rod end 44 of the antenna coil 42 is open circuited and the end 46 of antenna wire 43 is conducted inside the Lucite rod 40 to a diode detector and regenerator circuit mounted inside container 32. A high frequency diode is mounted inside the type N fitting 48 to rectify the helical antenna 36 output for the regenerator circuit (not shown in FIG. 2).

The helical antenna 36 has an omnidirectional radiation pattern above the ground plane or approximately hemispherical with a 1250–12,500 megacycle frequency response.

The detector or regenerator circuit must satisfy a number of conflicting requirements in order to function properly. The detector must remain quiescent for a relatively long time (500 hours or more) and then, upon the incidence of a radar beam at maximum radar range, must ignite an explosive charge to quickly destroy the balloon 14.

Variations in radar pulse width and pulse repetition frequency make the discrimination between radar signal and noise somewhat difficult while the detection of a radar signal at maximum range requires a fairly high gain amplifier with a correspondingly low signal to noise ratio output from the antenna.

As shown in FIG. 3 in block diagram form, the detector circuit begins with the helical antenna 36 indicated by number 50, diode detector 52 for rectifying the antenna output, and a video amplifier 54 for amplifying the detector 52 output sufficiently to trigger a fixed pulse length blocking oscillator 56. Blocking oscillator 56 charges up integrator 60 through amplifier 58 until, after 4 or 5 radar pulses, electronic switch 64 is turned on through amplifier 62 to operate amplifier 66 and ignite the squib or explosive charge 68.

Figure 4:
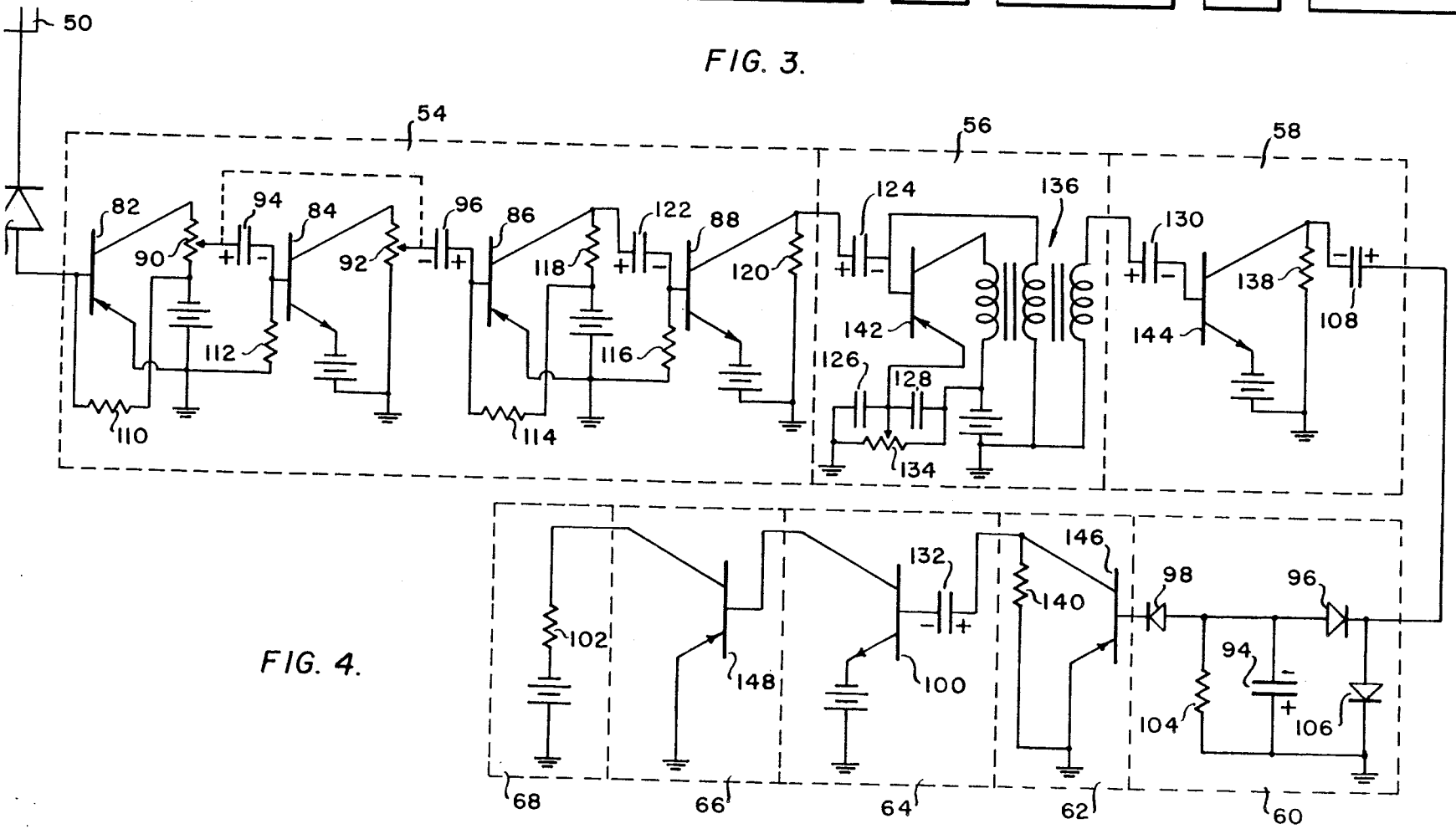
FIG. 4 is a schematic diagram of the regenerator circuit.

As shown in schematic form in FIG. 4, the helical antenna 50 is connected to diode detector 52. Amplifier 54 has four transistors 82, 84, 86 and 88 cascaded in the PNP-NPN alternate connection for a sensitivity of −40 dbm. Load resistors 90 and 92 are ganged potentiometers to adjust the total gain of amplifier 54 from 0to −40 dbm depending on the desired destruction range of 5 to 100 nautical miles.

Negative pulses of over 0.2 μs in length from amplifier 54 will trigger blocking oscillator 56 which delivers a 10 microsecond, 6 volt pulse to integrator 60. The blocking oscillator pulse by means of isolating amplifier 58 charges integrator capacitor 94 up through diode 96 until, at −4.0 volts or after 4 or 5 pulses, Zener diode 98 breaks down to pulse amplifier 62. Amplifier 62 turns on the electronic switch 64 which comprises a transistor 100. The transistor which stays turned on after diode 98 breaks down, energizes amplifier 66 to ignite the squib or explosive charge 68, indicated as resistor 102.

Video amplifier 54 has a 5 megacycle pass band and blocking oscillator 56 requires a pulse of 0.2 μs wide so that noise pulses or very short range radar pulses will not trigger oscillator 56. The fixed pulse length of 10 μs from the blocking oscillator 56 makes the charging of integrating capacitor 94 independent of radar pulse length although faster triggering will occur from higher pulse repetition frequency radar.

In a preferred embodiment of the detector circuit the following components were used:

Diode 52 - IN 26
Diode 96, 106 - IN63
Diode 98 - Type 650 C 3, Texas Ins. Co., Dallas, Tex.
Transistors 82, 86, 142, 146, -2N248
Transistors 144 - 2N596
Transistors 84, 88 - 2N338
Transistors - 148 - 2N230
Transistors 100 - Solid State Products, Salem, Mass.
Resistors 90, 92 - 5,000 ohms
Resistors 104, 118 and 120 - 500,000 ohms
Resistors 110, 112, 114 and 116 - 120,000 ohms
Resistor 134 - 2,000 ohms
Capacitor 94 - 0.1 micro farad
Capacitors 108, 122, 124, 126, 128, 130 and 132 -20 micro farads
Transformer 136 - UTC - H - 68 by United Transformer Co., Chicago, Ill.
Resistors 138 and 140 - 10,000 ohms All of the transistors normally operate near the collector cut-off state so that only a negligible leakage current of 2 ma is required for long operating periods.

The transistorized detector circuit including the common 6 volt mercury battery occupies container 32 which is a cube of only 1.5 inches on a side and weighs only six ounces. This light weight is easily supported by the top of balloon 14 in the most optimum position for maximum radar signal pickup.

Obviously many modifications and variations of the present invention are possible in the light of the above teachings. It is therefore to be understood that within the scope of the appended claims the invention may be practiced otherwise than as specifically described.

What is claimed is:

1. A radar countermeasure comprising an inflatable balloon, a corner reflector mounted inside said balloon, and means mounted on top of said balloon for destroying said balloon upon the incidence of a search radar beam.

2. A radar countermeasure according to claim 1 and further characterized by said last named means comprising a helical antenna, a squib, and means connected between said antenna and said squib for discriminating between radar signals and noise and firing said squib upon the incidence of a radar beam on said antenna.

3. A radar countermeasure according to claim 2 and further characterized by said last named means including means for counting a plurality of radar pulses.

4. A radar countermeasure according to claim 3 and further characterized by said last named means comprising an integrating capacitor.

5. A radar countermeasure according to claim 4 and further characterized by said counting means including a Zener diode having a predetermined breakdown voltage.

6. A radar countermeasure according to claim 1 and further characterized by a chemical canister having means for generating hydrogen gas and a gas tube connected between said canister and balloon.

7. A radar countermeasure according to claim 6 and further characterized by means in said canister for automatically regulating the gas pressure in said balloon.

8. A radar countermeasure according to claim 7 and further characterized by said regulating means comprising a vent tube attached to the bottom of said canister.

9. A regenerator for a radar countermeasure comprising a radar receiving antenna, a diode connected to said antenna, a standard length pulse generator connected to said diode responsive to radar signals having a period of over 0.2 microseconds, means connected to said generator for providing an output when a plurality of pulses are emitted from said pulse generator in a predetermined period of time, and an explosive charge connected to the output of said last named means for providing a warning signal upon the incidence of a search radar sweep.

10. A regenerator for a radar countermeasure comprising a helical antenna having a wide band radar frequency response, a diode detector connected to said antenna for detecting radar waves incident on said antenna, a wide band amplifier connected to said detector comprising a plurality of PNP-NPN connected cascaded transistors, a transistor blocking oscillator connected to said amplifier requiring a 0.2 microsecond length input pulse and having a 2 microsecond length output pulse whereby intermittent noise signals may be discriminated against, an integrating capacitor connected to said blocking oscillator for summing said output pulses and having a short discharge time as compared with the sweep period of a search radar, a Zener diode connected to said capacitor having a predetermined breakdown voltage proportional to the sum of 4 or 5 output pulse from said oscillator as summed on said capacitor, an electronic switch connected to said Zener diode, and a balloon destroying squib connected to said switch.

11. A radar countermeasure comprising an inflatable balloon, a corner reflector mounted inside said balloon, and means mounted on top of said balloon for destroying said balloon upon the incidence of a search radar beam, said means comprising a radar receiving antenna, a diode connected to said antenna, a standard length pulse generator connected to said diode responsive to radar signals having a period of over 0.2 microseconds, means connected to said generator for providing an output when a plurality of pulses are remitted from said pulse generator in a predetermined period of time, and an explosive charge connected to the output of said last named means for providing a warning signal upon the incidence of a search radar sweep.

12. The invention as described in claim 11 further characterized by a chemical canister having means for generating hydrogen gas and a gas tube connected between said canister and balloon.

13. The invention as defined in claim 12 and further characterized by means in said canister for automatically regulating gas pressure in said balloon.

14. The invention as defined in claim 13 and further characterized by said regulating means comprising a vent tube attached to the bottom of said canister.

15. A radar countermeasure comprising an inflatable balloon, a corner reflector mounted inside said balloon, and means mounted on top of said balloon for destroying said balloon upon the incidence of a search radar beam, said means comprising a helical antenna having a wide band radar frequency response, a diode detector connected to said antenna for detecting radar waves incident on said antenna, a wide band amplifier connected to said detector comprising a plurality of PNP-NPN connected cascaded transistors, a transistor blocking oscillator connected to said amplifier requiring a 0.2 microsecond length input pulse and having a 2 microsecond length output pulse whereby intermittent noise signals may be discriminated against, an integrating capacitor connected to said blocking oscillator for summing said output pulses and having a short discharge time as compared with the sweep period of a search radar, a Zener diode connected to said capacitor and having a predetermined breakdown voltage proportional to the sum of 4 or 5 output pulses from said oscillator as summed on said capacitor, an electronic switch connected to said Zener diode, and a balloon destroying squib connected to said switch.

16. The invention as defined in claim 15 and further characterized by a chemical canister having means for generating hydrogen gas and a gas tube connected between said canister and said balloon.

17. The invention as defined in claim 16 and further characterized by means in said canister for automatically regulating the gas pressure in said balloon.

18. The invention as defined in claim 17 and further characterized by said regulating means comprising a vent tube attached to the bottom of said canister.

* * * * *